US006416084B1

(12) United States Patent
Mantyla

(10) Patent No.: US 6,416,084 B1
(45) Date of Patent: Jul. 9, 2002

(54) REPLACEMENT FLANGE

(75) Inventor: James Mantyla, Barrie (CA)

(73) Assignee: Canplas Industries Ltd., Barrie (CA)

( * ) Notice: Subject to any disclaimer, the term of this patent is extended or adjusted under 35 U.S.C. 154(b) by 0 days.

(21) Appl. No.: 09/631,334

(22) Filed: Aug. 3, 2000

(51) Int. Cl.[7] ..... E03D 11/00
(52) U.S. Cl. ..... 285/56; 4/252.1; 4/252.4
(58) Field of Search ..... 285/56, 57, 58, 285/59, 60, 42, 88; 4/252.1, 252.4, 252.5, 252.6

(56) References Cited

U.S. PATENT DOCUMENTS

| | | | | |
|---|---|---|---|---|
| 1,031,531 A | | 7/1912 | Cramer | |
| 1,809,413 A | * | 6/1931 | Hirshstein | 285/42 |
| 2,436,070 A | | 2/1948 | Lassa | |
| 3,312,483 A | | 4/1967 | Leadbetter et al. | |
| 3,319,268 A | | 5/1967 | Blumenkranz | |
| 3,662,642 A | | 5/1972 | Bernard | |
| 3,775,780 A | | 12/1973 | McEwen | |
| 3,893,221 A | | 7/1975 | Lehmann | |
| 3,896,510 A | | 7/1975 | O'Connell | |
| 4,109,327 A | | 8/1978 | Jones | |
| 4,256,010 A | | 3/1981 | Petrie | |
| 4,541,658 A | | 9/1985 | Bartholomew | |
| 4,907,301 A | * | 3/1990 | Tucker | 285/56 X |
| 5,056,208 A | | 10/1991 | Stafford | |
| 5,484,242 A | | 1/1996 | Meyer | |
| 5,492,372 A | | 2/1996 | Dranberg | |
| 5,632,632 A | | 5/1997 | Huotari | |
| 5,890,239 A | | 4/1999 | Hite | |
| 6,026,521 A | * | 2/2000 | Atkins | 285/56 X |

* cited by examiner

*Primary Examiner*—Lynne H. Browne
*Assistant Examiner*—David E. Bochna
(74) *Attorney, Agent, or Firm*—Hoffmann & Baron, LLP

(57) ABSTRACT

There is provided replacement flange for attachment to a plumbing fitting having an inlet end, an outlet end attachable to a pipe and a pre-existing attachment groove. The replacement flange comprises a rim having a central opening. The central opening is sized and shaped to allow attachment of the rim to the inlet end while the outlet end is attached to the pipe. The flange also includes a lip projecting inwardly from the rim along a portion of a perimeter of the central opening. The lip is sized and shaped to engage a portion of the groove. The flange also includes at least one locking tab mounted to the rim and being movable between an unlocked position and a locked position, the tab being sized, shaped and positioned such that the rim is detachable from the plumbing fitting when the locking tab is in the unlocked position, but not when the tab is in the locked position.

18 Claims, 3 Drawing Sheets

REPLACEMENT FLANGE

FIELD OF THE INVENTION

This invention relates generally to the field of plumbing fittings, namely, to plumbing fittings for connecting toilets to waste water drainage systems. More particularly, this invention relates to repairing such fittings.

BACKGROUND OF THE INVENTION

Ordinary floor toilets contained in typical residential and commercial building washrooms require a connection through the floor to the waste water drainage system. Water closet flanges are a type of plumbing fitting used to connect such toilets to the drainage system.

A typical water closet flange has two components. The first is the pipe connector. The pipe connector accepts the toilet horn at one end and is connectable, for example, by means of a bell connector at its other end, with a drainage pipe. The pipe connector also typically includes a seat for housing a seal to seal the connection between the pipe and the toilet. This seal is required by building codes and prevents sewer gases and the like from entering the washroom.

The second component of the plumbing fitting is an attachment flange. The attachment flange is secured to the floor, and is also attached to the pipe connector. The attachment flange typically includes openings which allow it to be secured to the floor, and allow the toilet to be secured to the flange.

In some cases, both the pipe connector and the attachment flange are formed from plastic. In other cases, the pipe connector is formed from moulded plastic, but the attachment flange is formed from metal. Over time, in the humid environment of a typical washroom, metal attachment flanges tend to corrode, and require replacement.

In the typical replacement situation, the toilet is first disengaged from the water closet flange. The attachment flange and pipe connector are then exposed and the replacement of the attachment flange can begin. When replacing the corroded attachment flange, it is preferable to leave the pipe connector in place, because the pipe connector is attached to the waste pipe under the floor, and the joint between the waste pipe and the pipe connector is therefore inaccessible.

U.S. Pat. No. 3,319,268 issued to Blumenkranz discloses a water closet flange comprising a plastic annular pipe connector and an annular ring. The ring has an annular lip extending radially inwardly around the entire circumference of the ring. The ring also contains a number of angularly spaced slots therethrough which are adapted to receive toilet fastening members. The central opening in the ring (surrounded by the lip) is specifically sized so as to have the lip fit snugly in a groove located near the upper end of the pipe connector. The diameter of the portion of pipe connector located above the groove is larger than the diameter of the groove, so that the pipe connector is supported by the ring.

This device has the disadvantage of not being replaceable without disengaging the pipe connector from the waste pipe. This is because the upper end of the pipe connector is of larger diameter than the central opening. As a result, replacing this type of attachment flange requires the installation of a whole new fitting which is awkward, inconvenient and expensive.

U.S. Pat. No. 5,492,372 discloses a system to replace the flange only. The replacement flange comprises a pair of arcuate semi-circular pieces pinned at one end. Portions of the arcuate sections include an inwardly protruding lip for engagement with a groove. The ring can be installed on a connected pipe connector by opening the replacement flange and then closing it around the neck of the pipe connector with the lip engaged to the groove. The openable end of the replacement flange is then closed, and the flange is installed.

This attachment flange requires the manufacture of two separate pieces and the connection of the two pieces in a manner that allows them to rotate relative to one another. As a result, this attachment flange is both complex and expensive to manufacture.

U.S. Pat. No. 5,890,239 issued to Hite is directed to methods of repairing toilets. This patent discloses a replacement ring for use in a water closet flange. The replacement ring is a substantially flat circular ring which is sized to include a central opening larger than the locking groove of a pipe connector. Therefore, when the replacement ring is placed over the pipe connector and affixed to the floor, it does not fit into the locking groove in the pipe connector. As a result, the pipe connector is not securely retained by the replacement ring when the horn of the toilet is mounted into the pipe connector. This replacement ring has the disadvantage of not providing the structural stability to the toilet and pipe connector which is associated with having the flange lock onto a groove in the pipe connector.

Therefore, what is desired is an attachment flange which is simple, easy and inexpensive to manufacture, and can also be securely installed without needing to remove the balance of the fitting which remains in place.

SUMMARY OF THE INVENTION

Accordingly, the present invention is directed to a metal replacement flange for a plumbing fitting, where the fitting is provided with a pre-existing attachment groove. The replacement flange comprises a rim having a central opening which has a lip projecting inwardly from the rim along a portion of a perimeter of the central opening. The lip is sized and shaped to engage a portion of the pre-existing attachment groove. The replacement flange further comprises at least one locking tab mounted to the rim and being movable between an unlocked position and a locked position, the tab being sized, shaped and positioned such that the rim is detachable from the plumbing fitting when the locking tab is in its unlocked position, but not when it is in its locked position.

BRIEF DESCRIPTION OF THE DRAWINGS

Reference will now be made by way of example only to drawings of the present invention which illustrate the preferred embodiment of the invention, and in which.

DETAILED DESCRIPTION OF THE PREFERRED EMBODIMENTS

Figure 1:
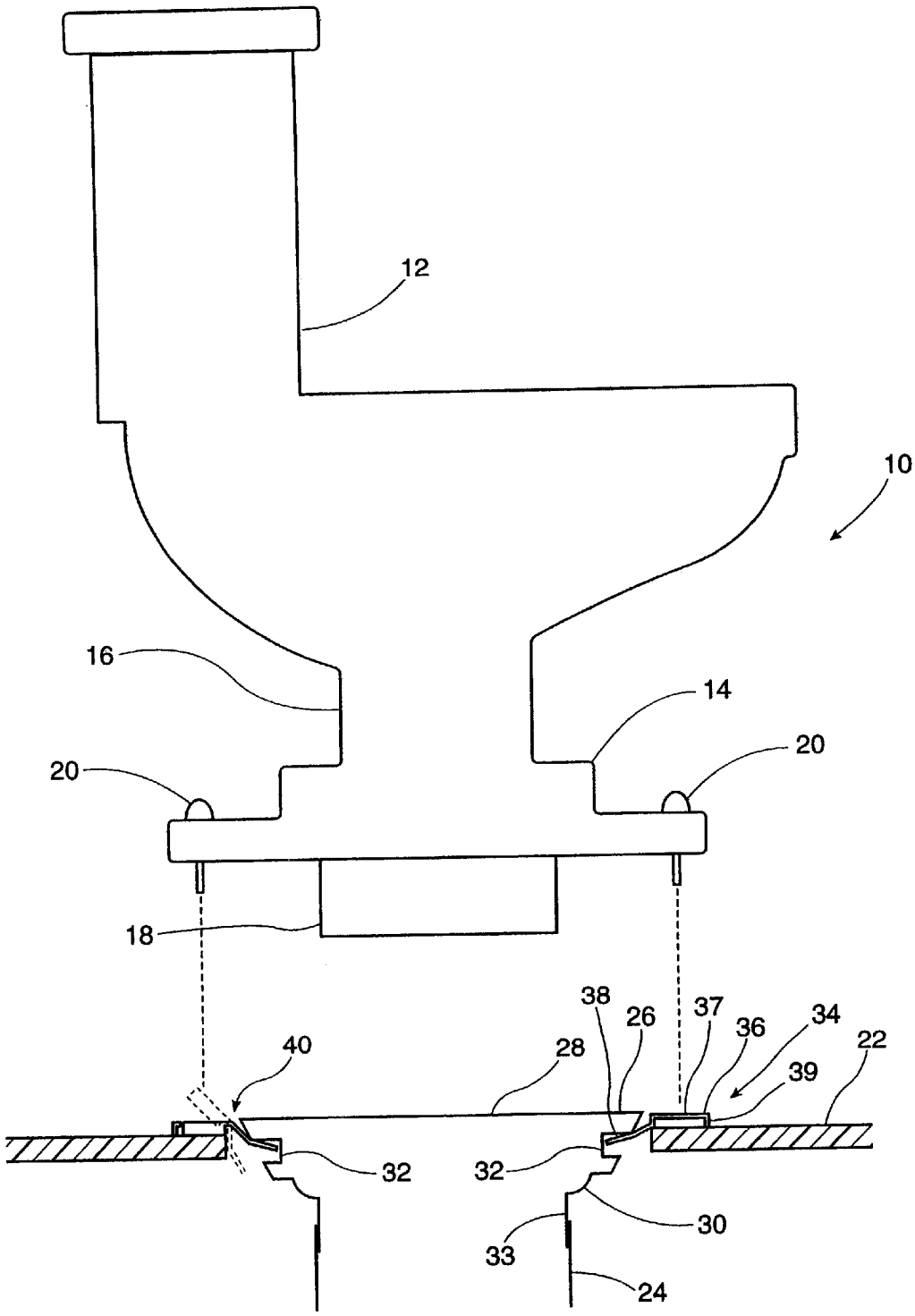
FIG. 1 is a cross-sectional exploded view of a toilet and waste pipe connection.

Referring now to FIG. 1, a toilet generally designated by reference numeral 10 is shown. The toilet 10 includes a body 12 and a base 14. The body 12 and the base 14 are connected by a conduit 16. The toilet 10 also includes a horn 18 extending from the base 14, through which water born waste travels. Mounted to the base 14 are securing means in the form of screws 20. The purpose of the screws 20 is to affix the toilet 10 to a closet flange, as described below, which in turn is fixed to the floor 22.

Below the floor 22 is a waste pipe 24. The purpose of the waste pipe 24 is to carry waste that has been flushed down the toilet 10 to the sewage system (not shown). The waste pipe 24 is connected to the toilet 10 by a plumbing fitting in the form of the pipe connector 26. The pipe connector 26 includes an inlet end 28, a seal seat 30, and a pre-existing attachment groove 32 extending around the circumference of the pipe connector 26. The pipe connector 26 also has an outlet end 33 attachable to the waste pipe 24. The purpose of the pipe connector 26 is to accept the horn 18 and provide a connection between the toilet 10 and the waste pipe 24. The seal seat 30 is adapted to carry a seal (not shown) which prevents sewer gases from leaking from between the horn 18 and the pipe connector 26 into a living space.

The purpose of the attachment groove 32 is to mate with a flange (either an original or a replacement) used for securing the pipe connector 26 to the floor 22. FIG. 1 shows a replacement flange 34 according to the present invention. The replacement flange 34 comprises a rim 36. Preferably, the rim 36 includes a body portion 37 and a spacer portion 39 which spaces the body portion 37 from the floor 22.

Attached to the rim 36 is a lip 38 which is sized and shaped to engage a portion of the attachment groove 32. The replacement flange 34 also includes two locking tabs 40 as more particularly described below. It will be appreciated by those skilled in the art, that the lip 38 could take many forms, including continuous as shown, intermittent, and could extend more or less around the circumference. What is desired is to provide a part which projects enough to engage the attachment groove of a conventional pipe connector 26.

The replacement flange 34 may be composed of any material which is strong, durable and flexible enough to function as a structural member, as is needed to anchor the toilet in place. However, such a replacement flange will typically be required to replace a metal flange, usually in a jurisdiction where metal flanges are either required or preferred. Therefore, the replacement flange will preferably be composed of metal. Most preferably, the replacement flange will be composed of stainless steel, so as to minimize corrosion and maximize the operating life of the replacement flange. However, reduction of corrosion may also be achieved through use of another metal which is enamel-coated or painted to slow corrosion.

Figure 2:
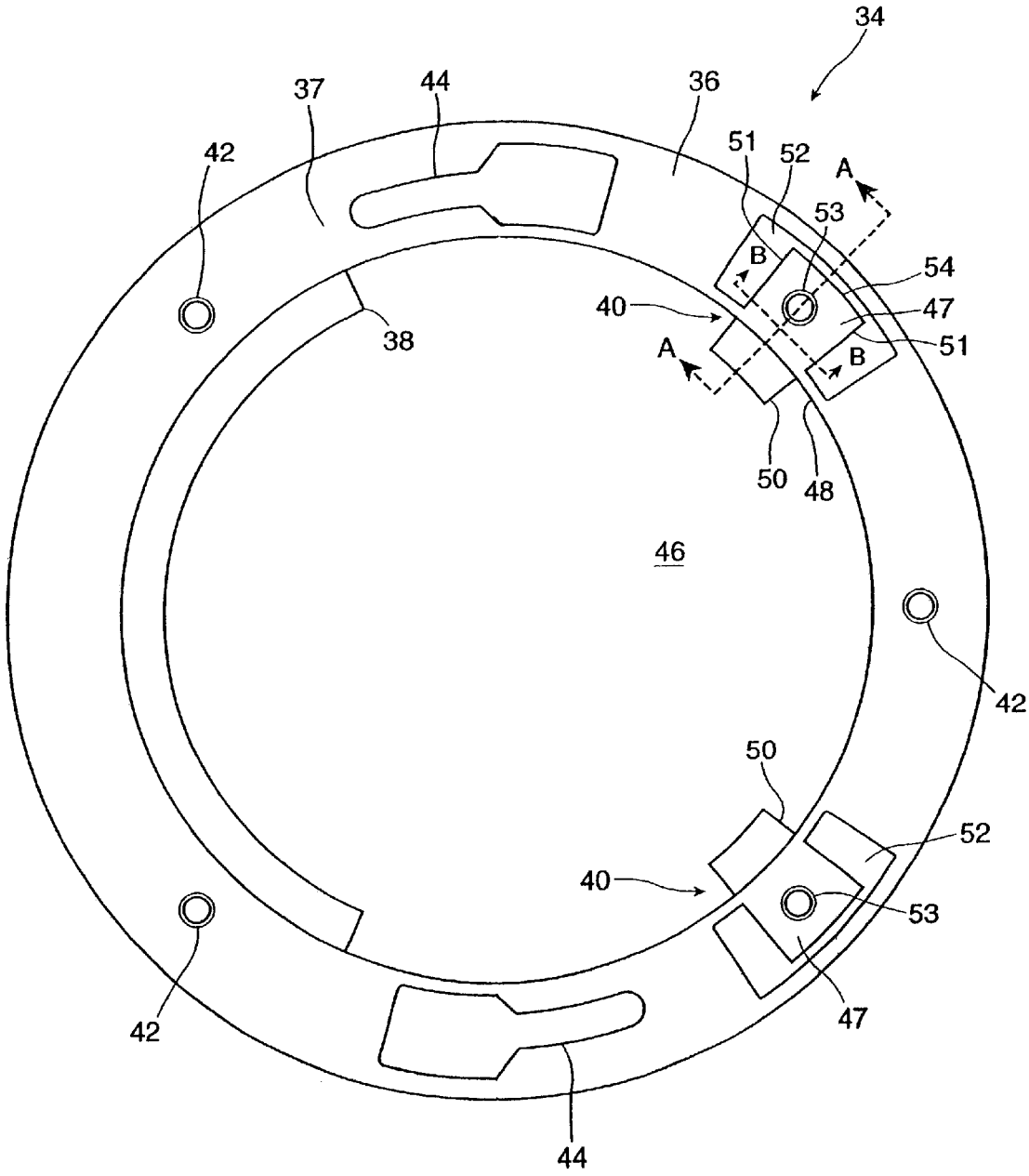
FIG. 2 is a plan view of the replacement flange according to the present invention.

Referring now to FIG. 2, the rim 36 has means for attaching the rim 36 to the floor in the form of three floor-attachment holes 42. There are also toilet-attachment holes 44 are sized and shaped to interact with the screws 20 extending through the base 14 of the toilet 10. The floor-attachment holes 42 are sized and shaped to permit rim 36 to be screwed, nailed or otherwise attached to the floor 22. It will be appreciated that the means for attaching the rim 36 to the floor may comprise any means which facilitates the securing of the rim 36 to the floor 22. While the form of toilet-attachment holes 44 in the rim 36 is conventional as shown, it will be appreciated that the means for attaching the rim 36 to the toilet 10 may be any means (such as for example, clips or hooks) which facilitates the securing of the rim 36 to the toilet 10.

The rim 36 is, in the preferred embodiment, a continuous closed loop, for strength. However, it could be in any form, provided it has a central opening 46. The lip 38 projects inwardly from the rim 36 into the central opening 46 along a portion of the perimeter of the central opening 46. The central opening 46 is sized and shaped so as to allow the rim 36 to be attached to the inlet end 28 of the pipe connector 26, while the outlet end 33 remains attached to the waste pipe 24, even with the lip 38 extending into the central opening 46. In this way the replacement flange 34 can be installed without disconnecting the pipe connector 26 from the waste pipe 24.

In most cases, the waste pipe 24, pipe connector 26 and horn 18 will be of circular cross-section. The central opening 46 would then preferably be substantially circular. In such a case, the lip 38 preferably extends approximately ⅓ of the way around the perimeter of the central opening 46. In determining the length of the lip 38, two considerations are at play. First, the greater the arc angle of the lip 38, the more secure will be the engagement between the lip 38 and the attachment groove. However, a longer lip 38 also makes it more difficult to size and shape the central opening 46 so as to allow the rim 36 to fit over the top of the pipe connector 26 while still sizing and shaping the lip 38 to engage the attachment groove. This is because the lip 38 impinges on the central opening 46. It has been found that having the lip 38 extend one-third of the way along the perimeter of the central opening 46 provides sufficiently secure engagement with the attachment groove 32 while allowing the replacement flange to be easily placed over the pipe connector 26.

Also, as shown in FIG. 2, it is preferred that two of the floor-attachment holes 42 be positioned near the ends of the lip 38, and the third be positioned between the tabs 40. This wide distribution of the floor attachment holes allows for stable, secure attachment of the rim 36 to the floor.

It will be appreciated that the rim 36 may be a closed shape as shown, or may contain a gap. What is important is that the rim 36 have a central opening and be sufficiently strong and stable to allow the pipe connector 26 to be held securely when the rim 36 is attached to the pipe connector 26 (as described below) and to the floor 22.

The locking tabs 40 may be of any configuration wherein they can attach the rim 36 to the pipe connector 26. However, the locking tabs 40 each preferably comprise an actuator portion 47, a bridge portion 48 and a lock portion 50. Each of the actuator portions 47 has two side edges 51 and an end edge 54. Each of the actuator portions 47 and the lock portions 50 are attached to a bridge portion 48, and in turn the bridge portion 48 is attached to the rim 36.

The rim 36 preferably has two locking tabs 40 mounted to it. Each tab 40 is movable between an unlocked position and a locked position. The tabs 40 are sized, shaped and positioned such that the rim 36 is detachable from the pipe connector 26 when the tabs 40 are in their unlocked position, but not when they are in their locked position.

The rim 36 further includes tab openings 52 for each tab 40 in the preferred embodiment. The actuator portion 47 and the lock portion 50 are movable between a locked position and an unlocked position. The actuator portion 47, in its unlocked position, extends up from the rim 36 and does not sit in the tab opening 52. When the actuator portion 47 is in the unlocked position, the lock portion 50 extends substantially perpendicular to the plane of the central opening 46 in the opposite direction from the actuator portion 47, and does not project substantially into the central opening 46. This allows the rim 36 to fit over the pipe connector 46. The actuator portion 47 may be bent into the locked position, wherein the actuator portion 47 is rotated down into the tab opening 52 and becomes substantially flush with the body portion 37. Upon such movement of the actuator portion 47, the bridge portion 48 twists in response, thus rotating the lock portion 50 so that it extends into the central opening 46. The lock portion 50, in its locked position, is sized and shaped and positioned to engage the attachment groove 32 in the pipe connector 26, thus attaching the rim 36 to the pipe connector.

It will be appreciated by those skilled in the art that the rim 36 may be attached to the pipe connector 26 without the tabs 40 engaging the attachment groove 32. The requirement for operation of the invention is simply that the tabs 40 cause the rim 36 not to be detachable from the pipe connector 26 when the tabs 40 are in the locked position. So, for example, the tabs 40, in their locked position, may grip the pipe connector 26 in some other way (e.g. through pressure/friction against the pipe connector 26). It is further appreciated that the tabs may be mounted for other movement, besides twisting, such as sliding in and out between the unlocked and locked position. What is required is for there to be a first position in which the opening is sized and shaped to permit the rim to fit over the fitting and be attached thereto, and a second position where the opening is small enough to prevent removal of the rim therefrom.

The tabs 40 and in particular the bridge portion will most preferably be plastically deformable, such that the tabs 40 remain in place when placed in either the unlocked position or the locked position. In this way, the rim 36 can be installed without the installer needing to maintain pressure on the tab. The tabs 40 also preferably include locked-position-securing means in the form of floor-attachment apertures 53 in the actuator portions 47. These apertures 53 allow the tabs 40 to be nailed, screwed or otherwise secured in their locked position at the conclusion of installation of the flange 34. It will be appreciated that the floor attachment apertures 53 can simultaneously function as means for attaching the rim 36 to the floor 22. To ensure secure attachment to the floor, however, it is preferable that there be provided separate means for attaching the rim 36 to the floor 22.

Figure 3:
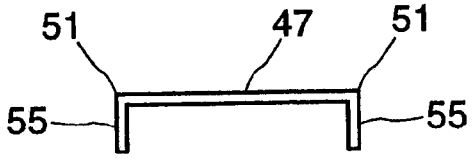
FIG. 3 is a cross-sectional view of a portion of the locking tab along line B—B shown in FIG. 2.

Referring now to FIG. 3, attached to the actuator portions 47 are tab-floor spacing means in the form of tab spacers 55 extending downward from the side edges 51. The tab spacers 55 are of the same height as the spacer portion 39.

Figure 4:
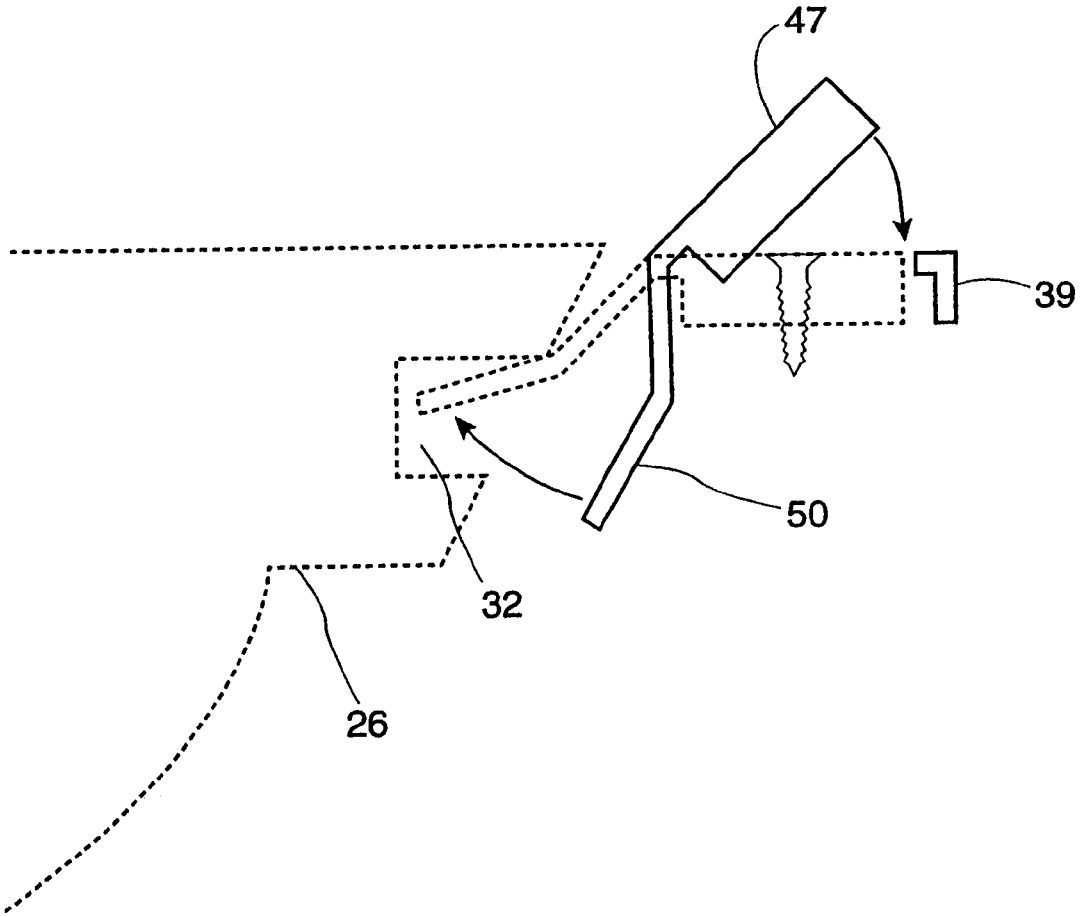
FIG. 4 is an enlarged cross-sectional view of the replacement flange along line A—A of FIG. 2.

FIG. 4 shows a tab 40, with its unlocked position shown by the solid line and the locked position shown by dotted line. In the unlocked position, the lock portion 50 extends into the opening 46. The lock portion 50 is sized, shaped and positioned to engage the attachment groove 32 when in its locked position.

It can now be appreciated how the replacement flange 34 is used. When a corroded metal flange requires replacement, the toilet 10 is detached from the corroded flange and from the floor 22. The corroded flange is then removed. As discussed above, it is desirable to be able to install a replacement flange 34 without detaching the pipe connector 26 from the waste pipe 24. Such detachment would be difficult, as the connection between the pipe connector 26 and the waste pipe 24 is not easily accessible from above the floor 22. In order to install the replacement flange 34 in such a manner, it is necessary to be able to place the rim 36 over the top of the pipe connector 26.

Thus, prior to installation, the tabs 40 are in the unlocked position. The lip 38 and the lock portions 50 are sized, shaped and positioned so as to engage the attachment groove 32 when the lock portions 50 are in their locked position. Therefore, when the lock portion 50 is in its unlocked position and does not extend into the central opening 46, the central opening 46 is sized and shaped so that it can be placed over the top of the pipe connector 26. Once the replacement flange 34 is placed over the top of the pipe connector 26, so that the top of the pipe connector 26 extends through the central opening 46, the lip 38 is inserted into the attachment groove 32. The actuator portions 47 are then bent down so that they lie flush within the tab openings 52. As the actuator portions 47 are hammered downward, the lock portions 50 rotate so that they extend forward into the central opening 46. The lock portions 50 are sized, shaped and positioned so as to engage the attachment groove 32 when in their locked position. The lock portions 50 engage the attachment groove 32 tightly and attach the replacement flange 34 to the pipe connector 26.

It will be appreciated by those skilled in the art that the tab spacers 55 prevent the actuator portion 47 from being pushed below the level of the body portion 37 when the locking tabs 40 are moved into their locked position. This in turn prevents the attached lock portion 50 from exerting an upward force on the pipe connector 26 through the attachment groove 32, which may have the effect of detaching the pipe connector 26 from the pipe 24.

It will be appreciated by those skilled in the art that there must be at least one locking tab 40, but otherwise there may be any number of locking tabs 40 distributed along the rim 36 for the replacement flange 34 to operate according to the present invention. When installing the replacement flange 34, however, a balance will preferably be struck between ease of installation and secure attachment of the replacement flange 34. Having more tabs creates stronger attachment, but makes installation more difficult and time consuming. It has been found that having two locking tabs 40 mounted on the rim 36 provides adequately strong attachment while not unduly lengthening installation time. Therefore, there will most preferably be two locking tabs 40 mounted on the rim 36 to provide the optimum balance between strong locking and low installation time and effort.

Similar considerations apply to determining the positions of the tabs. It is preferable to position the tabs so as to maximize the strength of attachment achieved by whatever number of tabs are in use. It has been found that a generally symmetrical distribution of the tabs along the portion of the rim 36 where the lip 38 is absent produces the best results. In the case of two tabs 40 being used, good results have been obtained by positioning each of the two tabs 40 opposite one of the floor-attachment holes 42 located adjacent to the lip 38 (i.e. on a diameter of the substantially circular central opening 46 which passes through a floor-attachment hole 42 located adjacent to the lip 38). Since the apertures 53 can also function to attach the rim 36 to the floor, this positioning provides stable, secure attachment of the rim 36 to the floor. It also helps provide stable and secure attachment of the tabs 40 to the pipe connector 26. As a result, the two tabs 40 are located generally opposite the ends of the lip 38 (i.e. on a diameter of the substantially circular central opening 46 which passes near or adjacent to an end of the lip 38).

While the foregoing embodiments of the present invention have been set forth in considerable detail for the purpose of making a comprehensive disclosure of the invention, it will be apparent to those skilled in the art that various modifications can be made to the device without departing from the scope of the invention as defined in the attached claims. Some of these variations are discussed above and others will be apparent to those skilled in the art. For example, the locking tabs may be of any configuration that allows them to attach the rim 36 to the pipe connector 26. What is considered important in the present invention is providing a replacement flange which can be easily manufactured, and conveniently and securely installed.

I claim:

1. A replacement flange for attachment to a plumbing fitting, said plumbing fitting having an inlet end, an outlet end attachable to a pipe and a pre-existing attachment groove, said replacement flange comprising:

a rim having a central opening, said central opening being sized and shaped to allow attachment of said rim to said inlet end while said outlet end is attached to said pipe, said rim further including means for attaching said rim to a floor;

a lip projecting inwardly from said rim along a portion of a perimeter of said central opening, said lip being sized and shaped to engage a portion of said pre-existing attachment groove; and at least one locking tab mounted to said rim and being movable between an unlocked position and a locked position, said tab being sized, shaped and positioned such that said rim is detachable from said plumbing fitting when said locking tab is in said unlocked position, but not when said tab is in said locked position.

2. The replacement flange of claim 1 wherein said locking tab is sized and shaped to engage said pre-existing attachment groove when said locking tab is in said locked position, whereby said rim is not detachable from said plumbing fitting when said tab is in said locked position.

3. The replacement flange of claim 2, said locking tab being plastically deformable, wherein said locking tab remains in said locked position when moved thereto from said unlocked position.

4. The replacement flange of claim 3, said locking tab including locked-position-securing means.

5. The replacement flange of claim 4, said locked-position-securing means comprising floor-attachment-apertures through said locking tab.

6. The replacement flange of claim 2, said replacement flange including two locking tabs, said central opening being substantially circular, said lip extending along approximately one-third of said perimeter, each said locking tab being mounted to said rim generally opposite an end of said lip.

7. The replacement flange of claim 3, said central opening being substantially circular, said replacement flange including two locking tabs, said lip extending along approximately one-third of said perimeter, each said locking tab being mounted to said rim generally opposite an end of said lip.

8. The replacement flange of claim 1, said locking tab comprising an actuator portion, a bridge portion and a lock portion;

said actuator portion and said lock portion each being attached to said bridge portion such that said lock portion moves when said actuator portion is moved, said bridge portion being attached to said rim;

said bridge portion being plastically deformable upon movement of said actuator portion; and said lock portion being sized, shaped and positioned such that said rim is detachable from said plumbing fitting when said locking tab is in said unlocked position, but not when said tab is in said locked position.

9. The replacement flange of claim 8 wherein said lock portion is sized and shaped to engage said pre-existing attachment groove when said locking tab is in said locked position, whereby said rim is not detachable from said plumbing fitting when said locking tab is in said locked position.

10. The replacement flange of claim 9, said central opening being substantially circular, said replacement flange including two locking tabs, said lip extending along approximately one-third of said perimeter, each said locking tab being mounted to said rim generally opposite an end of said lip.

11. The replacement flange of claim 8, said central opening being substantially circular, said replacement flange including two locking tabs, said lip extending along approximately one-third of said perimeter, each said locking tab being mounted to said rim generally opposite an end of said lip.

12. The replacement flange of claim 1, said means for attaching said rim to a floor comprising floor attachment holes in said rim.

13. The replacement flange of claim 12, said rim further including toilet-attachment holes therein.

14. The replacement flange of claim 1, said replacement flange being composed of metal.

15. The replacement flange of claim 14 wherein said metal is stainless steel.

16. The replacement flange of claim 1, said replacement flange including two locking tabs.

17. The replacement flange of claim 16, said central opening being substantially circular, said lip extending along approximately one-third of said perimeter, each said locking tab being mounted to said rim generally opposite an end of said lip.

18. A replacement flange for attachment to a plumbing fitting, said plumbing fitting having an inlet end, an outlet end attachable to a pipe, and a pre-existing attachment groove, said replacement flange comprising:

a rim having a substantially circular central opening, said central opening being sized and shaped to allow attachment of said rim to said inlet end while said outlet end is attached to said pipe, said rim further including floor-attachment holes and toilet attachment holes;

a lip projecting inwardly from said rim and extending along approximately one-third of a perimeter of said central opening, said lip being sized and shaped to engage a portion of said pre-existing attachment groove; and two locking tabs each mounted to said rim generally opposite an end of said lip, each of said tabs comprising an actuator portion, a bridge portion and a lock portion, said actuator portion and said lock portion each being attached to said bridge portion such that said lock portion moves when said actuator portion is moved, said bridge portion being attached to said rim, said bridge portion being plastically deformable upon movement of said actuator portion, wherein said tab remains in said locked position when moved thereto, said lock portion being sized and shaped to engage said pre-existing attachment groove when said tab is in said locked position and to allow said rim to be detached from said fitting when said tab is in said unlocked position, whereby said rim is not detachable from said plumbing fitting when said tab is in said locked position; each of said actuator portions having a floor attachment aperture therethrough.

* * * * *